United States Patent [19]

Renkus

[11] 4,336,425

[45] Jun. 22, 1982

[54] HIGH FREQUENCY COMPRESSION DRIVER AND METHOD OF MANUFACTURE THEREOF

[75] Inventor: Jonas A. Renkus, Santa Ana, Calif.

[73] Assignee: Renkus-Heinz, Inc., Irvine, Calif.

[21] Appl. No.: 147,180

[22] Filed: May 6, 1980 (Under 37 CFR 1.47)

[51] Int. Cl.[3] ..... H04R 9/02; H04R 9/04; H04R 9/06; H04R 31/00

[52] U.S. Cl. ..... 179/115.5 H; 29/594; 179/115.5 R; 179/115.5 PC; 179/115.5 VC

[58] Field of Search ..... 29/594; 179/115.5 R, 179/115.5 BS, 115.5 ES, 115.5 H, 115.5 PC, 115.5 VC, 117, 119 R, 120

[56] References Cited

U.S. PATENT DOCUMENTS 2,162,270 6/1939 Mott ..... 179/115.5 R
4,256,930 3/1981 Garner et al. ..... 179/115.5 PC

FOREIGN PATENT DOCUMENTS 939879 3/1956 Fed. Rep. of Germany ..... 179/115.5 H
1130854 6/1962 Fed. Rep. of Germany ..... 179/115.5 H
1153421 8/1963 Fed. Rep. of Germany ..... 179/115.5 PC

*Primary Examiner*—George G. Stellar
*Attorney, Agent, or Firm*—Knobbe, Martens et al.

[57] ABSTRACT

A high frequency compression driver is disclosed in which the driver assembly is secured by two threaded studs. The studs not only hold the cover, magnet assembly and horn together, but also play a vital role in ensuring that the various elements of the assembly do not shift with respect to each other. The studs also serve as a basis for centering the voice coil precisely between the poles of the driver magnet. Although the magnet assembly is manufactured with ordinary machine tolerances, the diaphragm and voice coil are centered through the use of two precisely machined fixtures. The cover of the assembly acts as an effective heat sink for the diaphragm to keep its temperature low and improve the reliability of the device. The diaphragm itself is manufactured at low cost, is replaceable and is given structural integrity by the cover and the pole ring.

19 Claims, 10 Drawing Figures

Fig. 5
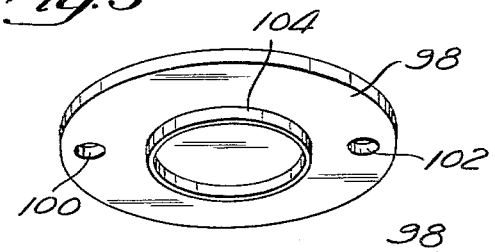
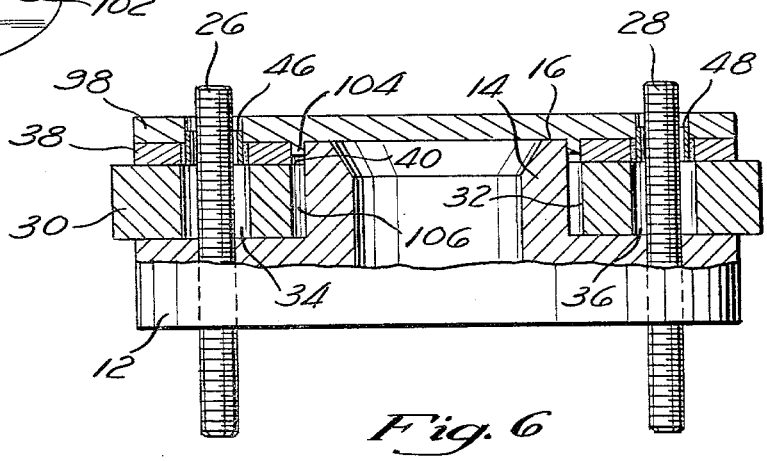
Fig. 6
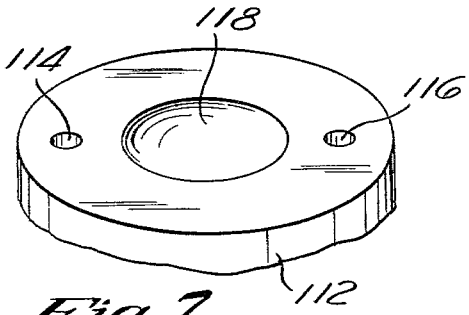
Fig. 7
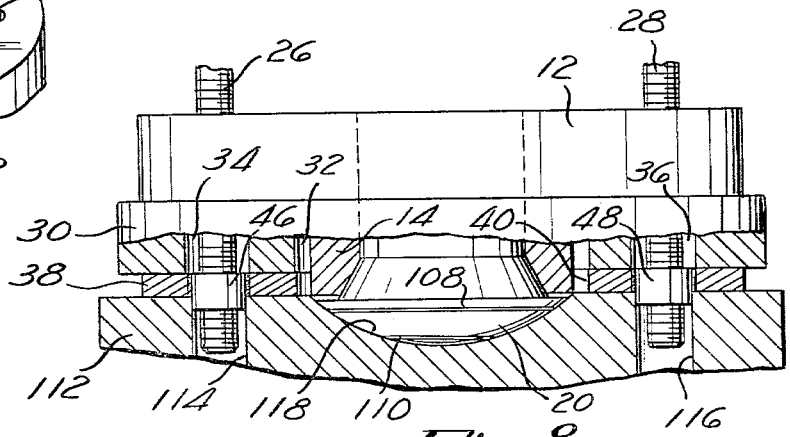
Fig. 8
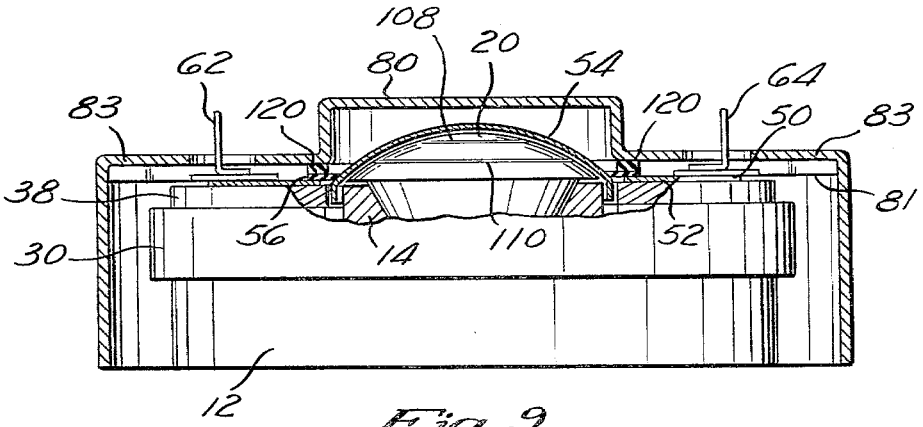
Fig. 9

HIGH FREQUENCY COMPRESSION DRIVER AND METHOD OF MANUFACTURE THEREOF

BACKGROUND OF THE INVENTION

The invention generally relates to high frequency compression drivers and methods of manufacturing thereof. Such drivers are used for speaker systems calling for high quality sound reproduction at high volume as required in recording studios, theaters and the like.

A typical driver presently being marketed is composed of a base formed of magnetizable material having a centrally located upraised cylindrical portion. Surrounding this cylindrical magnetizable portion is an annular magnet having a central opening through which the cylindrical portion extends. An annular pole ring of magnetizable material also surrounds the cylindrical portion and is mounted upon the magnet. The cylindrical portion and pole ring serve as magnetic poles with the inner circumference of the pole ring being precisely spaced from the outer circumference of the cylindrical portion. A diaphragm having a downwardly extending cylindrical former around which a voice coil is wound is then mounted on the pole ring. Critical to the performance of the driver is the positioning of the voice coil between the spaced poles of the magnet. Thus, the circular voice coil must be precisely radially spaced between the inner circumference of the pole ring and the outer circumference of the cylindrical portion.

In prior devices, this voice coil centering has been accomplished by precisely machining the pole ring. For example, in one prior device, a circular indentation positioned radially outward from the central opening of the pole ring is precisely machined to receive the diaphragm. The diameter and concentricity of the indentation is predetermined to accurately radially space the voice coil from the inner circumference of the pole ring. The pole ring is then accurately mounted on the magnet to provide a predetermined distance between the inner circumference of the pole ring and the outer circumference of the cylindrical pole.

In another prior art device, the pole ring has a series of apertures arranged in a circle radially spaced from the inner circumference of the ring. These apertures are adapted to receive mounting posts upon which the diaphragm is mounted. By using these mounting posts, the voice coil is radially spaced a precise distance from the inner circumference of the pole ring. The pole ring, as in the other prior device, must then be precisely positioned with respect to the other cylindrical pole.

These prior devices suffer from a serious disadvantage that each pole ring in every device must be carefully machined which adds greatly to the cost of the device and is also a time-consuming process.

It is also extremely important, once the device is assembled, that the various elements not shift with respect to each other. Specifically, it is critical that the two pole members not shift with respect to each other, thereby destroying the proper positioning of the voice coil between them. In prior devices, the pole members and magnets are glued to each other. For example, the upper surface of the annular magnet is glued to the lower and adjacent surface of the pole ring. Maintaining the proper positioning of the pole ring therefore depends upon the shear strength of the glue. However, since a glue's shear strength is not nearly as great as its compression strength, the pole rings of such devices can be jarred into misalignment with respect to the voice coil and other pole member.

A typical diaphragm assembly used in prior devices consists of a circular disc having a centrally located dome-shaped diaphragm. The voice coil is attached to a cylindrical former which extends downward from the dome-shaped diaphragm. Extending upward from the outer circumference of the disc is a plastic rim which rests against the cover of the assembly. Thus, no portion of the surface area of the diaphragm is in contact with the cover. Such diaphragms have a tendency to overheat since they are not provided with a heat sink to dissipate heat energy which accumulates during the operation of the device. Moreover, such diaphragms assemblies are bulky and expensive to replace.

In prior devices, the diaphragm assembly typically includes electrical terminations on the upraised plastic rim. Wires extend from these terminations through apertures in the cover to exterior terminations on the cover. Typically, the covers are held against the diaphragm assembly through the use of screws. The number of electrical wires and terminations involved in prior devices increase the likelihood of electrical connection problems. Moreover, in order to gain access to the diaphragm, one must unscrew at least three or four screws which require a screw driver. Thus, in order to gain access to the magnet assembly and diaphragm, one must have room in order to use a screw driver and have freedom of hand manipulation. This is often not possible or convenient depending upon the location of the particular driver involved.

There is therefore a distinct need for a high frequency compression driver which can be manufactured simply and economically, and whose components can be easily replaced. In particular, there is a need for a method for centering the voice coil between the poles of the magnet without requiring expensive and time-consuming machining of the pole ring.

There is also a need for a diaphragm assembly which is easily replaceable and manufactured at low cost and which is provided with an adequate heat sink. Finally, there is a need for a device in which the elements of the magnet assembly are prevented from shifting with respect to each other after the voice coil has been properly aligned between the poles.

SUMMARY OF THE INVENTION

The disclosed invention obviates the disadvantages of prior drivers and methods of manufacture thereof. In the manufacture of the inventive driver, threaded studs are threaded through diametrically positioned threaded apertures in a pole piece which has an upraised, central cylindrical portion having an accurate outer diameter. This cylindrical portion forms one of the magnetic poles between which the voice coil will be positioned. The pole piece is machined with ordinary tolerances which are far less restrictive than that required for the voice coil positioning. The depth of the studs is determined by a fixture which has apertures of a specified depth into which the studs are threaded. A magnet having diametrically opposed apertures is loosely positioned over the studs and glued to the pole piece. The studs are then secured against rotation by glue inside the magnet apertures. The compressive strength of the glue also prevents the magnet from shifting against the pole piece.

An annular pole ring which also has diametrically positioned apertures is provided. The pole ring, with its large central opening that is accurately sized and its diametric apertures are machined with ordinary tolerances. These tolerances with respect to the spatial relationship of the opening and apertures are substantially greater than the tolerances which are required for the positioning of the voice coil between the poles of the magnet, i.e., the pole piece and the pole ring.

The necessary precision required in positioning the voice coil is achieved in the pole ring and diaphragm assembly procedures which are as follows. Bushings are loosely fit within the diametrically opposed apertures of the pole ring. A fixture is used to accurately position the bushings with respect to the inner circumference of the pole ring. This precise positioning of the bushings through the use of the fixture serves to radially and tangentially space the voice coil from the inner circumference of the pole ring. Thus, the fixture accurately positions the bushings a predetermined radial and concentric distance from the inner circumference of the ring. The outsides of the bushings are then glued to the pole ring.

A second fixture is then used to make the pole ring concentric with the upraised cylindrical portion of the pole piece. In other words, the second fixture precisely determines the radial space between the inner circumference of the pole ring and the outer circumference of the cylindrical portion of the pole piece.

When the pole ring has been precisely positioned with respect to the pole piece, the pole ring is glued in place and the second fixture is removed. The inside of the bushings are also glued against the studs. The studs therefore also serve to anchor the pole ring and prevent it from shifting against the magnet. The interaction of the glue between the studs and other assembly elements, such as the bushings, helps prevent the elements from shifting because in order to shift, the elements must work against the compression strength of the glue, which is much greater than its shear strength.

Next, a phasing plug is placed within the opening formed by the upraised cylindrical portion of the pole piece. The depth of the phasing plug is determined by a third fixture and is then glued in place.

The next element is the insertion of the diaphragm assembly which consists of a flat, annular disc that surrounds a central dome-like diaphragm. A former fastened to the underside of the dome-like diaphragm extends downward to provide a cylindrical rim around which the voice coil is wound. The flat, annular disc has two precisely positioned diametrically opposed apertures which fit over the previously positioned bushings in the pole ring. The diaphragm is precision centered with respect to the two opposed apertures during the assembly process of the diaphragm assembly. Thus, the accurate centering and positioning of the voice coil between the magnetic poles is automatically accomplished by fitting the diaphragm assembly apertures over the bushings. The diaphragm assembly is light in weight and is manufactured at low cost and can be easily and accurately replaced.

A cover is placed over the diaphragm assembly by aligning diametrically opposed apertures in the cover with the studs. The cover gives the diaphragm assembly structural integrity as does the pole ring. The cover also serves as a heat sink for the diaphragm assembly and is easily removable by simply unscrewing two nuts which cover the end of the studs. Electrical terminations on the diaphragm assembly extend through diametrically positioned larger openings in the cover.

The invention therefore requires no precise machining of the pole ring. The fixturing results in ideal coil concentricity permitting operation even at high power operation which results in temperature stressing. This is in sharp contrast to the prior drivers discussed above in which the pole ring is accurately machined in an expensive and time-consuming process. Secondly, the structure is simplified over prior devices and inherently allows the studs to secure all parts including the cover and horn attachment of this device. The interaction of the studs and glue with the elements also helps prevent any shifting of the elements after assembly. Thirdly, the diaphragm assembly is light in weight and given structural integrity by the cover and pole ring. It is therefore easily replaceable and, in addition, does not require additional leads to connect to the outside terminals. Rather, the electrical terminations are part of the diaphragm assembly itself and are accessed through openings in the cover. The cover provides an important heat sinking function for the diaphragm assembly and also can easily be removed by simply unscrewing two nuts. Finally, there is an absolute minimum number of parts and hardware which results in a compact lightweight and cost efficient design.

These and other advantages will be clarified in the discussion below, and in reference to the drawings in which:

FIG. 5 is a perspective view of the second fixture which is used to position the poles of the magnet;

FIG. 6 is a side cross-sectional view of the second fixture of FIG. 5 positioned on the magnet assembly;

FIG. 7 is a perspective view of the third fixture which is used to determine the depth of the phasing plug;

FIG. 8 is a side cross-sectional view of the magnet assembly with the third fixture shown in FIG. 7 being used to position the phasing plug;

FIG. 9 is a side cross-sectional view of the inventive driver showing the cover attached.

DETAILS OF THE PREFERRED EMBODIMENTS

Figure 1:
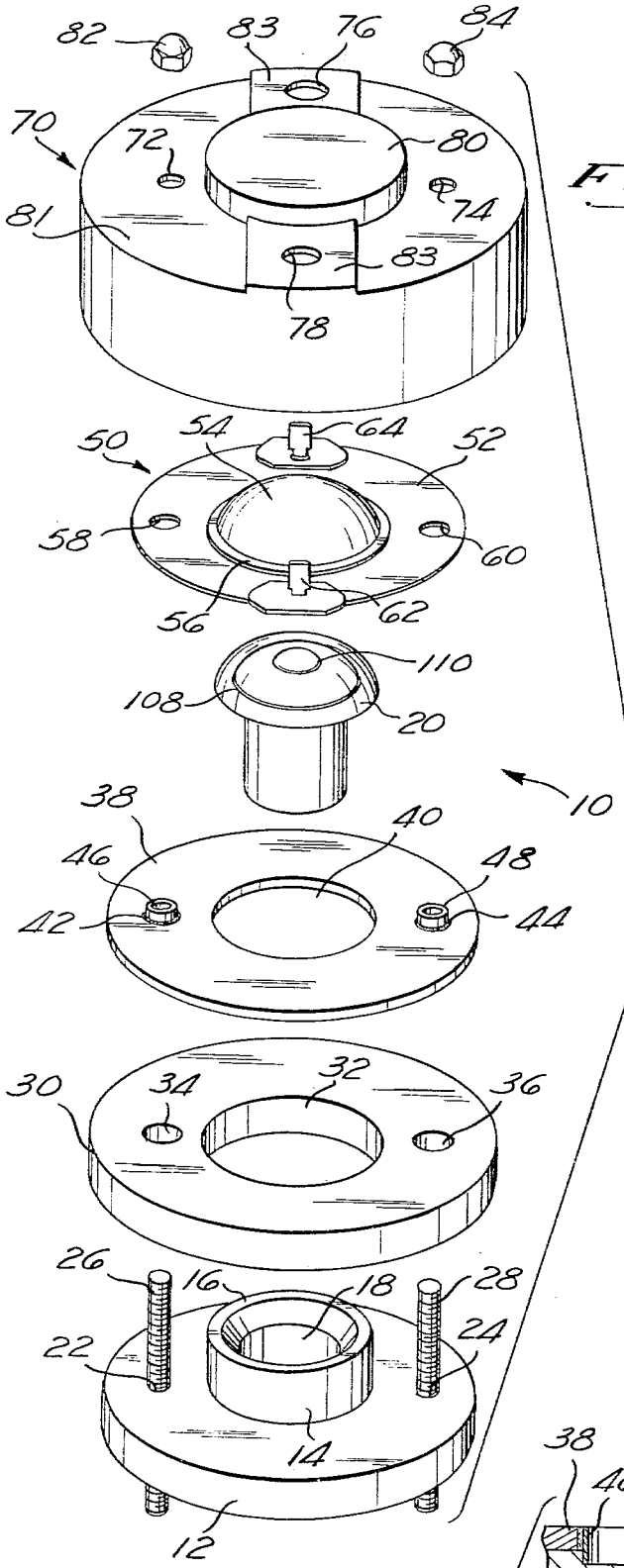
FIG. 1 is an exploded perspective view of the inventive driver.

Referring to FIG. 1, exploded elements of the high frequency compression driver 10 are shown. The driver 10 has a pole piece 12 which has an upraised central cylindrical portion 14. The cylindrical portion 14 has a circular rim 16 which surrounds a central opening 18. The rim 16 and the opening 18 are formed to receive a phasing plug 20 as will hereinafter be described.

The pole piece 12 is composed of a soft magnetic material, such as iron with low carbon content. Such materials are magnetizable when placed in a magnetic field as is well known in the art.

The next major element of the assembly is a ceramic magnet 30 which is annular in shape. The magnet 30 has a large central opening 32 and diametrically opposed smaller apertures 34 and 36 which fit over the studs 26 and 28.

The third component is an annular pole ring 38 which has a large central opening 40 and diametrically opposed smaller apertures 42 and 44 to fit over the studs 26 and 28. Positioned within the aperture 42 is a first bushing 46 and positioned within the aperture 44 is a second bushing 48.

The pole ring 38 is made of a magnetic material similar to that of the pole piece 12. When the driver 10 is assembled, it will be placed in a strong magnetic field thereby permanently magnetizing the ceramic magnet 30. The ceramic magnet 30, in turn, provides a magnetic character to the pole piece 12 and the pole ring 38. Thus, the cylindrical portion 14 of the pole piece 12 and the pole ring 38 become magnetic poles.

The next component of the assembly is a diaphragm assembly 50. The diaphragm assembly 50 has a flat, annular disc 52 which surrounds a central dome-like diaphragm 54. Between the annular disc 52 and the dome-like diaphragm 54 is an annular, flexible rubber connector 56 which permits axial movement of the driver. The disc 52 has diametrically opposed apertures 58 and 60. Mechanically connected to the flat, annular disc 52 are diametrically opposed electrical terminations 62 and 64.

Figure 2:
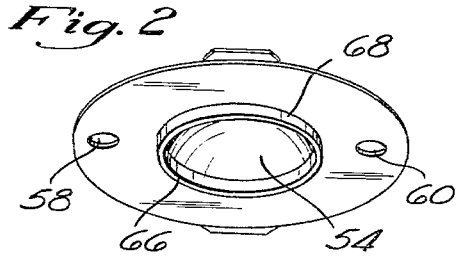
FIG. 2 is a perspective view of the underside of the diaphragm assembly shown in FIG. 1.

Referring to FIG. 2, the underside of the diaphragm assembly 50 is shown. The central dome-like diaphragm 54 has a downwardly extending cylindrical rim 66 around which the voice coil 68 is wound. As is known in the art, the diaphragm 54 vibrates in response to an electromagnetic force created by the voice coil 68 as it carries an electric signal in the magnetic field created by the magnet 30 between the magnetic poles composed of the pole ring 38 and upper cylindrical portion 14 of the pole piece 12. The voice coil is electrically connected to the terminations 62 and 64.

A critical aspect of assembling a high frequency compression driver is to accurately position the voice coil between poles of the magnet. Thus, the voice coil 68 must be precisely concentrically positioned and radially spaced from the outer circumference of the cylindrical portion 14 and the inner circumference of the pole ring 38. This diaphragm centering process will hereinafter be described.

Referring again to FIG. 1, a cover 70 is shown having diametrically opposed apertures 72 and 74 for receiving the studs 26 and 28. The cover 70 also has larger diametrically opposed openings 76 and 78 for receiving the terminations 62 and 64. The cover 70 has an upraised central cylindrical cap 80 to provide acoustical stiffening for the diaphragm 54. The cap 80 rests upon a flat top portion 81 which has slightly upraised diametrically positioned portions 83 that provide space for the area of the diaphragm assembly 50 adjacent the electrical terminations 62 and 64. The portions 83 thereby allow the remaining portion of the top 81 of the cover 70 to seat flush against the disc portion 52 of the diaphram assembly 50 as will be described. Nuts 82 and 84 complete the elements of the assembly.

The method of manufacture of the driver 10 will now be described. Referring to FIG. 1, the threaded studs 26 and 28 are threaded into the apertures 22, 24 in the pole piece 12. As described above, the studs 26, 28 are threaded to a specified depth through the use of a fixture. The apertures 22, 24 in the pole piece 12 are designed to snugly hold the studs 26, 28. The cylindrical portion 14 is machined with an accurate outer diameter. Importantly, the spatial alignment of the apertures 22,24 is machined with ordinary tolerances. These tolerances are substantially less restrictive than the tolerances to be achieved in positioning the voice coil 68 between the outer circumference of the cylindrical portion 14 and the pole ring 38. Thus, the pole piece 12 can be machined easily at much less expense than if the apertures 22,24 were machined to be accurately aligned. In short, it is far easier to machine an accurate diameter than apertures in accurate spatial alignment.

The ceramic magnet 30 is then placed on top of the pole piece 12 by passing the studs 26, 28 through the apertures 34, 36 in the magnet 30. The cylindrical portion 14 of the pole piece 12 thereby extends through the large central opening 32 in the magnet 30. The magnet apertures 34, 36 are substantially larger than the outside diameter of the studs 26, 28 so that the magnet fits quite loosely over the pole piece 12. The magnet 30 is then glued in place on top of the pole piece 12. The studs 26, 28 are also secured against rotation by glue which is placed in the space between the outer diameter of the studs 26, 28 and the inside of the magnet apertures 34, 36. This glueing operation prevents the magnet 30 from shifting against the pole piece 12. Thus, in order for the magnet 30 to shift with respect to the pole piece 12, the magnet 30 must compress the glue against the studs 26, 28. An epoxy glue well known in the art has been found to be satisfactory. Such glue has a much higher compression strength than shear strength, and thus the combination of the studs 26, 28 and the glue makes it difficult for the magnet 30 to shift with respect to the pole piece 12. It should be understood that there is no requirement for the magnet 30 to be precisely aligned with respect to either the cylindrical portion 14 or the pole ring 38. Thus, the magnet 30 need be positioned just so as not to interfere with the space between the poles of the magnet into which the voice coil 68 is placed as will hereinafter be described.

Figure 3:
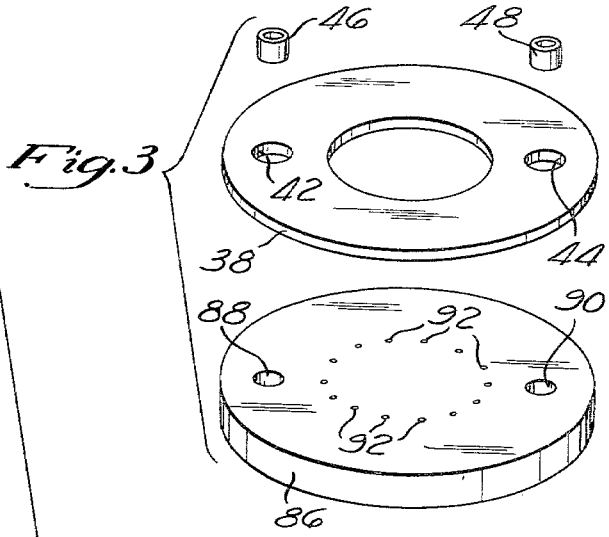
FIG. 3 is an exploded view of the pole ring with bushings positioned by use of the first fixture.
Figure 4:
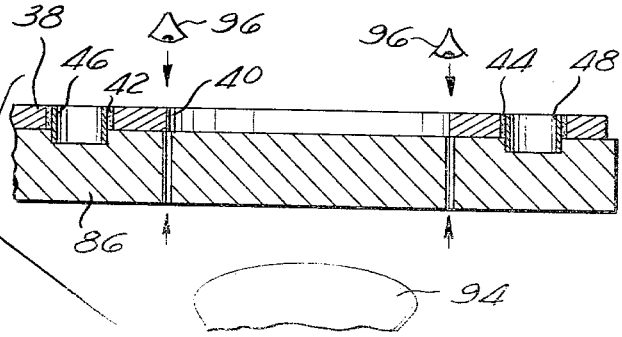
FIG. 4 is a side cross-sectional view of the fixture of FIG. 3 being used to position the bushings within the apertures of the pole ring.

The assembly of the pole ring 38 will now be described with reference to FIGS. 3 and 4. Referring to FIG. 3, the pole ring 38 is shown positioned above a first fixture 86. The first step in assembling the pole ring is to place the bushings 46, 48 within the pole ring apertures 42, 44. It should be understood that the pole ring 38 like the pole piece 12 is manufactured with ordinary machine tolerances. The only requirement is that the central opening 40 be machined with an accurate diameter. Thus, the size of the apertures 42, 44 and their position with respect to the central opening 40 is machined with tolerances far less restrictive than that required for the positioning of the voice coil 68 between the poles of the magnet.

The first fixture 86 is precisely machined to position the bushings 46, 48 with respect to the inner circumference of the pole ring 38 which forms the central opening 40. This bushing positioning process ensures that the voice coil 68 will be radially spaced from the inner circumference of the pole ring 38 a precise distance as will become clear in the succeeding discussion. The first fixture 86 has diametrically opposed recesses 88 and 90. Centrally located on the fixture 86, are smaller openings 92 which are arranged in a circle. The openings 92 extend completely through the fixture 86. In a preferred embodiment, the openings are 0.002 inches in diameter.

The use of the first fixture 86 will now be described with reference to FIG. 4. The pole ring 38 is placed on the fixture 86 so that the bushings 46, 48, positioned within the apertures 42, 44 are placed within the recesses 88, 90 of the first fixture 86. A light source 94 is located below the first fixture 86. The operator then looks from above the fixture 86 and aligns the pole ring 38 with respect to the first fixture 86 such that approximately one-half of the surface area of each of the small openings 92 is opened to permit passage of light from the source 94 to the eye 96 of the operator. The other half of the surface area of the openings 92 is covered by the circumference of the opening 40 of the pole ring 38. With the bushings 46, 48 thus properly aligned, they are then permanently glued in place in the apertures 42, 44.

The next step in the centering process is to make the pole ring 38 concentric with the cylindrical portion 14 of the pole piece 12. In other words, the circumference of the opening 40 of the pole ring 38 must be radially spaced a precise distance from the outer circumference of the cylindrical portion 14. Since the positioning of the bushings 46, 48 described above will accurately radially space the voice coil 68 from the inner circumference of the central opening 40, the precise radial spacing of the inner circumference of the pole ring 38 from the outer circumference of the cylindrical portion 14 will automatically ensure that the voice coil 68 will be precisely positioned between the poles of the magnet.

Referring to FIG. 5, a second fixture 98 is shown having diametrically opposed apertures 100, 102 and a centrally located, downwardly extending, cylindrical boss 104.

Referring to FIG. 6, the pole ring 38 is shown placed on the assembly of the pole piece 12 and magnet 30, with the studs 26, 28 extending through the pole ring apertures 42, 44. It should be understood that the inner diameter of the bushings 46, 48 is larger than the outer diameter of the studs 26,28. Thus, the pole ring 38 is loosely mounted on the magnet 30 preceding placement of the second fixture 98. The second fixture 98 is placed upon the pole ring 38 by extending the studs 28, 28 through the second fixture apertures 100, 102. The downwardly extending cylindrical boss 104 of the second fixture 98 fits between the outer circumference of the upper cylindrical portion 14 of the pole piece 12 and the inner circumference of the opening 40 of the pole ring 38. The second fixture 98 and its boss 104 are precisely machined to accurately radially space the pole ring 38 from the cylindrical portion 14. A precisely determined space 106 provided by this alignment, as shown in FIG. 6, receives the voice coil 68, as will hereinafter be described. With the pole ring 38 properly positioned, it is glued in place to the magnet 30 and the second fixture 98 is removed. At the same time, glue is placed within the space between the inner circumference of the bushings 46, 48 and the outer circumference of the studs 26, 28. The studs therefore also serve to anchor the pole ring 38 and prevent it from shifting against the magnet 30.

Thus, the compressive strength of the glue which is placed between (1) the magnet 30 and the studs 26, 28 (2), the bushings 46, 48 and the pole ring 38 and (3) the bushings 46, 48 and the studs 26, 28 prevents shifting of any of these components with respect to each other. This is a distinct improvement over prior assemblies in which shifting was prevented simply by dependence upon the shear strength of the glue.

The phasing plug 20 is now placed within the opening 18 in the cylindrical portion of the pole piece 12. The plug 20, as shown in FIG. 1, may loosely fit within the opening 18. Alternatively, the phasing plug 20 may have plural axially extending ridges along its exterior surface.

As is well known in the art, the phasing plug 20 has slits 108 and 110, as shown in FIG. 1, which conduct the sound waves from the diaphragm 54. These slits 108 and 110 vary the distance which the sound waves from different portions of the diaphragm must travel, thereby combining such sound waves in phase at the front of the assembly so that they do not cancel one another.

The depth of the phasing plug in the opening 18 is determined by a third fixture 112 shown in FIGS. 7 and 8.

The third fixture 112 includes diametrically opposed apertures 114 and 116, and a centrally located recess 118 which is shaped to generally fit the top portion of the phasing plug 20. After the phasing plug 20 has been placed within the opening 18 formed by the upraised cylindrical portion 14 of the pole piece 12, the third fixture 112 is placed over the pole ring 38. This is done by aligning the apertures 114, 116 of the third fixture 112 with the studs 26, 28.

Referring to FIG. 8, the third fixture 112 is shown positioned adjacent the pole ring 38. For convenience, the assembly has been turned upside down so that the top of the phasing plug 20 has a tendency to rest against the recess 118 of the third fixture 112. The phasing plug 20 is then pushed in a direction toward the third fixture 112, until further movement is prevented by the depth of the recess 118. The phasing plug is then glued in place at this proper depth.

During the next assembly step, the apertures 58, 60 of the diaphragm assembly 50 are placed over the bushings 46,48. The cylindrical rim 66 upon which the voice coil 68 is wound, is positioned within the space 106 between the outer circumference of the cylindrical portion 14 and the inner circumference of the pole ring 38. In the preferred embodiment, the space between the voice coil 68 and the outer circumference of the cylindrical portion 14 is 0.009 inches. The radial space between the voice coil 68 and the inner circumference of the pole ring 38 is 0.006.

The annular disc 52 of the assembly 50 is precisely machined so that the apertures 58, 60 are in proper position and fit snugly over the bushings 46, 48. Thus, in order to properly position the voice coil between the poles of the magnet, the operator need only place the diaphragm assembly 50 on the pole ring 38. The centering of the diaphragm assembly 50 is automatically assured, since the positioning of the bushings 46, 48 within the pole ring 38 using the first fixture 86 and the positioning of the pole ring 38 upon the magnet 30 using the second fixture 98 has prealigned the space 106 and the bushings 46,48.

Finally, the cover 70 is placed over the diaphragm assembly 50 by aligning the apertures 72, 74 with the studs 26, 28. The cover 70 is held tightly against the diaphragm assembly 50 by tightening nuts 82, 84 on the ends of the studs 26, 28. When the cover is placed in position, the electrical terminations 62,64 on the diaphragm 50 extend through the openings 76, 78 without contacting the cover 70. Thus, external electrical leads may be directly attached to the diaphragm assembly 50.

As clearly shown in FIG. 9, the dome-like diaphragm portion 54 of the diaphram assembly 50 extends into the recessed cap 80 of the cover 70. The cap 80 therefore forms an accoustical cavity for diaphragm 54. Sealing strips 120 are positioned in the space between the upraised areas 83 of the cover 70 and the diaphragm assembly 50 to seal the cavity thereby providing for better speaker performance.

Note should be made that in the cross-sectional view of FIG. 9 the cover 70 is spaced from the disc portion 52 of the diaphragm 50. The spacing exists only adjacent the terminals 62, 64 in the upraised areas 83 of the cover 70 as shown in FIG. 1. As shown in FIG. 1, the remaining portion of the top 81 of the cover 70 will seat flush against the disc portion 52 of the diaphragm assembly 50. Since the cover 70 is in substantial surface area contact with the diaphragm disc 52, it serves as a heat sink to draw heat away from the diaphragm assembly 50 during use. The cover 70 also provides structural integrity to the lightweight diaphragm assembly 50, as does the pole ring 38 against which the diaphragm assembly 50 is pressed by the cover 70. The cover is easily removed by simply unscrewing the nuts 82, 84, if one requires access to the components of the driver 10. This is particularly important since it permits easy replacement of the diaphragm assembly 50.

Figure 10:
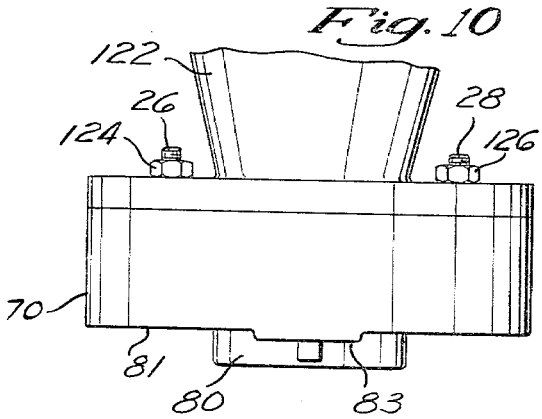
FIG. 10 is an elevational view of the inventive driver shown attached to a horn.

Referring to FIG. 10, the driver 10 is shown attached to a horn 122. The ends of the studs 26, 28 which extend through the pole piece 12 pass through the horn 122 and are secured by nuts 124, 126. Thus, the studs 26, 28 secure all parts of the driver assembly including the cover 70 and horn attachment 122.

The highly efficient driver of this invention will handle 30 to 50 watts of input power depending on coil size. The voice coil 68 is a current carrying conductor producing an eletromagnetic force as it carries the electric signal between the poles of the magnet 30. This electromagnetic force in turn vibrates the diaphragm 54 creating sound waves which travel outward through the phasing plug 20. These waves are phased by the plug 20 and proceed through the plug and pole piece 12 into the horn 122 attached to the driver by means of the threaded studs 26 and 28.

What is claimed is:

1. In assemblying a loud speaker, a method for contributing to precise positioning of a voice coil between two magnetic poles comprising:

(a) providing an annular member having a large central opening and at least two smaller apertures, said member being adapted to be one of said poles;

(b) positioning a bushing within each of said apertures;

(c) providing a fixture having depressions spaced to receive said bushings and having a plurality of small openings arranged in a circle in the central area of said fixture;

(d) providing a source of light beneath said fixture;

(e) placing said member on said fixture with the bushings positioned within said depressions; and (f) aligning said member with respect to said fixture such that said member permits a fraction of the area of each of said openings to transmit light through the central opening in said member.

2. A method for manufacturing a speaker having a cylindrical first magnetic pole which extends through a central opening in an annular second magnetic pole and a diaphragm assembly with apertures precisely positioned with respect to a voice coil, said voice coil being affixed to said diaphragm assembly and positioned between said first and second magnetic poles comprising:

(a) precisely aligning mounting means within apertures in said second magnetic pole with respect to said opening said mounting means being sized to fit tightly within said diaphragm assembly apertures;

(b) precisely spacing said first magnetic pole from said second magnetic pole; and (c) placing said apertures in said diaphragm assembly over said mounting means to precisely position said voice coil between said first and second magnetic poles.

3. A method for manufacturing a loud speaker having a cylindrical first magnetic pole which extends through a central opening in an annular second magnetic pole and a diaphragm assembly with apertures precisely positioned with respect to a voice coil, said voice coil being affixed to said diaphragm assembly and positioned between said first and second magnetic poles comprising:

positioning apertures in said second magnetic pole with respect to said opening with a first tolerance;

precisely spacing said first magnetic pole from the second magnetic pole with a tolerance which is more restrictive than said first tolerance;

precisely aligning mounting means within said apertures in said second magnetic pole with respect to said opening with a tolerance more restrictive than said first tolerance; and placing said diaphragm assembly apertures over said mounting means to precisely position said voice coil between said first and second magnetic poles.

4. The method of claims 2 or 3 wherein said mounting means is a bushing.

5. The method of claim 4 further comprising:

passing a stud through said apertures in said second magnetic pole and said diaphragm assembly to secure said speaker.

6. The method of claim 5 wherein the inner circumference of said bushing is larger than the outer circumference of said stud.

7. The method of claim 6 further comprising:

positioning glue between the outer circumference of said stud and the inner circumference of said bushings to prevent said first magnetic pole from shifting with respect to said second magnetic pole.

8. A method for manufacturing a speaker having a cylindrical first magnetic pole which extends through a central opening in an annular second magnetic pole and a diaphragm assembly having a voice coil attached thereto comprising:

(a) positioning apertures in said second magnetic pole with respect to said opening with a first tolerance;

(b) positioning bushings within said second magnetic pole apertures with respect to said opening with a tolerance which is more restrictive than said first tolerance;

(c) spacing the outer circumference of said first magnetic pole from the inner circumference of said second magnetic pole with a tolerance which is more restrictive than said first tolerance;

(d) positioning apertures in said diaphragm assembly with respect to said voice coil with a tolerance which is more restrictive than said first tolerance; and (e) placing said diaphragm assembly apertures over said bushings to precisely position said voice coil between said first and second magnetic poles.

9. A loud speaker assembly comprising:

(a) a cylindrical first magnetizable material;

(b) an annular second magnetizable material having a central opening through which said first magnetizable material extends and having apertures spaced from said opening, said first magnetizable material being spaced at a point of extension through said central opening from said second magnetizable material;

(c) bushings affixed within said second magnetizable material apertures; and (d) a diaphragm assembly having a cylindrical voice coil attached thereto, said voice coil being positioned between said first and second magnetizable materials said diaphragm assembly having apertures sized to fit snugly over said bushings.

10. The loud speaker of claim 9 further comprising: studs extending through said first magnetizable material, said bushings and said diaphragm assembly apertures to secure said loud speaker assembly.

11. The loud speaker of claim 10 wherein the inner circumference of said bushings is substantially larger than the outer circumference of said studs.

12. The loud speaker of claim 11 further comprising: glue placed between the inner circumference of said bushings and the outer circumference of said studs to prevent said second magnetizable material from changing position with respect to said first magnetizable material.

13. A loud speaker assembly comprising:

(a) a first magnetic pole having an upraised cylindrical portion;

(b) an annular second magnetic pole having a central opening through which said cylindrical portion extends said second pole having apertures located with a first tolerance, said second pole having an inner circumference which is precisely spaced from the outer circumference of said cylindrical portion;

(c) bushings precisely spaced within said second pole apertures; and (d) a diaphragm assembly having apertures located with a second tolerance, said second tolerance being more restrictive than said first tolerance, said diaphragm assembly being precisely aligned with respect to said first and second poles by positioning said bushings through said diaphragm assembly apertures.

14. A loud speaker assembly comprising:

(a) a cylindrical first magnetic material;

(b) an annular second magnetic material having an inner circumference precisely spaced from said cylindrical first magnetic material, said first and second materials adapted to be magnetic poles;

(c) a diaphragm assembly having a cylindrical voice coil mounted thereon; and (d) means for positioning said voice coil a precisely predetermined distance from the inner circumference of said second material, said voice coil positioning means comprising a bushing precisely positioned within an aperture in said second material, said diaphragm assembly having an aperture through which said bushing extends, said aperture being sized to closely fit said bushing.

15. A loud speaker assembly comprising:

(a) first and second magnetizable materials spaceably mounted from one another;

(b) a magnet which polarizes said materials;

(c) a stud extending through said assembly, said stud extending through an aperture in said second material;

(d) an adhesive positioned between said stud and said second material aperture to prevent said second material from shifting relative to said first material.

16. A loud speaker assembly comprising:

(a) a base having an upraised cylindrical portion composed of magnetic material;

(b) an annular magnet having a central opening mounted on said base, said cylindrical portion extending through said magnet opening;

(c) a magnetic annular member having a central opening mounted on said magnet, said cylindrical portion extending at least partially through said annular member opening;

(d) a stud extending through apertures in said base, magnet and annular member, said stud being secured against rotation by glue positioned between said stud and said magnet aperture.

17. The loud speaker of claim 16 further comprising glue positioned between said stud and said annular member aperture to prevent said annular member from changing position relative to said cylindrical portion.

18. The loud speaker of claim 16 further comprising:

a diaphragm assembly having a voice coil mounted on said annular member; and a cover having an aperture, one end of said stud extending through said cover aperture, said cover being held tightly against said diaphragm assembly by a nut attached to the end of said stud, said cover being easily removed from said loud speaker assembly by simply disengaging said nut from the stud.

19. A loud speaker assembly comprising:

(a) a base having an upraised cylindrical portion formed of magnetic material;

(b) a magnet mounted on said base;

(c) an annular member formed of magnetic material mounted on said magnet;

(d) a stud extending through apertures in said base, magnet and annular member to hold said base, magnet and annular member together;

(e) glue positioned between said stud and said magnet aperture and between said stud and said annular member aperture to prevent said cylindrical magnetic material, magnet and annular member from shifting with respect to one another.

* * * * *